US008689394B2

(12) United States Patent
Bettuzzi

(10) Patent No.: US 8,689,394 B2
(45) Date of Patent: Apr. 8, 2014

(54) WASHER DRYER SCRUBBING MACHINE

(76) Inventor: Vittoria Bettuzzi, Castelvetro (IT)

( * ) Notice: Subject to any disclaimer, the term of this patent is extended or adjusted under 35 U.S.C. 154(b) by 379 days.

(21) Appl. No.: 13/199,243

(22) Filed: Aug. 24, 2011

(65) Prior Publication Data

US 2012/0060318 A1 Mar. 15, 2012

(30) Foreign Application Priority Data

Sep. 15, 2010 (IT) ..... RE2010A0071

(51) Int. Cl.
*E01H 1/02* (2006.01)
*E01H 1/08* (2006.01)

(52) U.S. Cl.
USPC ..... 15/320; 15/340.4

(58) Field of Classification Search
USPC ..... 15/320, 340.1–340.4, 348, 349
See application file for complete search history.

(56) References Cited

U.S. PATENT DOCUMENTS 3,197,798 A 8/1965 Brown et al.
4,369,544 A * 1/1983 Parisi ..... 15/320
5,093,955 A * 3/1992 Blehert et al. ..... 15/320
6,735,812 B2 * 5/2004 Hekman et al. ..... 15/320
6,842,940 B2 * 1/2005 Christopher et al. ..... 15/320
7,337,490 B2 * 3/2008 Goff ..... 15/320
7,448,114 B2 * 11/2008 Basham et al. ..... 15/320
8,321,993 B2 * 12/2012 de Bree ..... 15/346

FOREIGN PATENT DOCUMENTS

EP 0726057 12/1995

* cited by examiner

*Primary Examiner* — Dung Van Nguyen
(74) *Attorney, Agent, or Firm* — Bucknam & Archer

(57) ABSTRACT

A washer-drier scrubbing machine includes a rotating roll brush the surface covered by spiked bristles facing upwards and towards the center near the front portion, and is covered by a casing which extends downwards and near the ground is provided with a "flap" having aligned openings oriented and facing the floor at the sides of the casing and facing the ground are sprayers fed with water-detergent mixtures pumped from a tank. Proximate the sprayers are arranged diffusers of compressed air which prevent the sprayed washing mixture from expanding outside the outline of the casing and being conveyed only towards the casing openings and towards a rotating brush and not beyond, on the track along which the machine proceeds the dirty water collected by the brush is sent to a tank through a separator which retains the high consistency dirt, and an intermediate container.

7 Claims, 1 Drawing Sheet

WASHER DRYER SCRUBBING MACHINE

Figure 1:
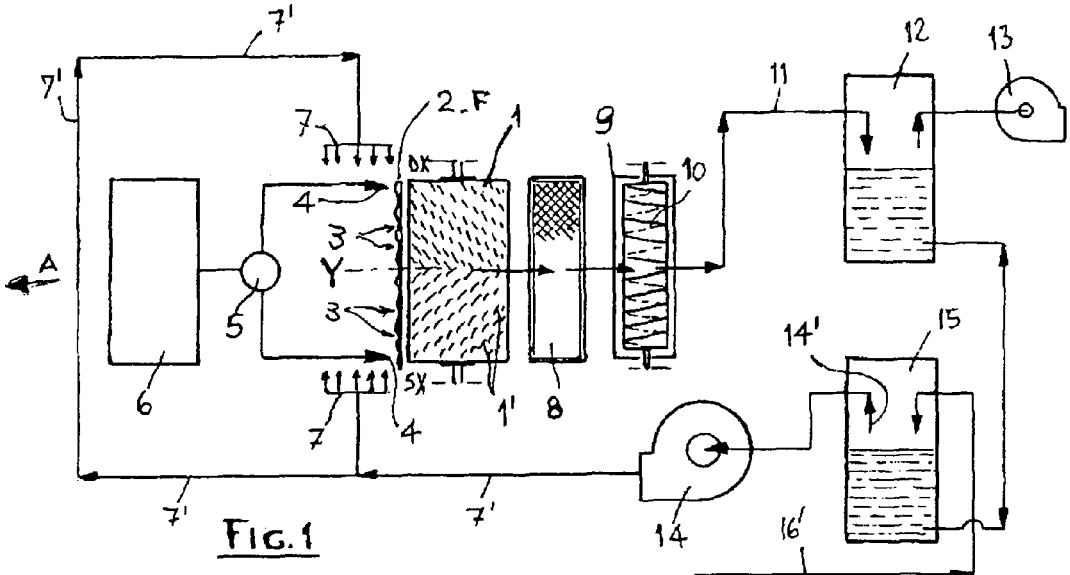

The invention relates to a washer-drier scrubbing machine provided with a front and side containing and guiding system for the flow of washing mixture introduced on the operating track thereof.

It is known that washer-dryer machines currently on the market are substantially configured with a tank-pump assembly for a water-detergent washing mixture dispensable in the proximity of a washing unit consisting of disk shaped flat brushes, or of pairs counter-rotating cylindrical brushes of small diameter, combined with a rear container intended for the collection of solid parts (such as debris and similar). The washing mixture coming from the tank is sent in the proximity of said rotating brushes and the dirty water and the small debris are conveyed in a separator container which retains them letting fall back on the floors the muddy water which is laterally scraped through curved rubber straps, is drawn by a pivoting floor wiper and is conveyed in a single recovery tank through a suction unit.

However, it has been widely highlighted that the generic configuration of currently marketed washer-dryer machines and of the generally known solutions show some not irrelevant drawbacks; namely it was noted that using said machines a significant dispersion on the ground of the washing mixtures occurs, especially along curvilinear paths, because no front containing and guiding mean for the washing fluid exists respect to the operating brushes, with the resulting waste of water and detergent, waste of time due to the constant emptying and refilling of the tanks, and the impossibility of a complete collection of dirty water which shall be dispersed in the environment, without being subject to decantation and recovery of the polluting substances contained therein.

Another drawback results from the fact that, in presence of counter-rotating cylindrical brushes of small diameter an excessive waste of washing mixture is shown especially on the sides and the rear of the unit, where are employed rubber straps which, in the bends, scrape the floor conveying the dirty water to the floor wiper; said action results as being rather poor especially in presence of dusty rooms, so that, on the bends, rims and marks of dirt remain and the abrasion of the rubbers, deriving from the brushing against the floors, especially the concrete ones, causes the failed collection of all the dirty liquids, and the need of adjustments and replacements of said rubbers.

It is, for example, disclosed by EP 0726057 a floor washing machine, provided with a tank containing a washing mixture, as well as means apt to distribute said mixture on the floor and recover it once the washing is completed. The solution described in this patent, however, does not result to be optimal because it does not provide the possibility to separate, during suction, solid residues having bigger volume and consistency from smaller ones. As a consequence, such machine, is not able to perform pre-sweeping functions on wet floors whereon dirt concentration is high; in such cases, in order to perform a correct cleaning, it is compulsory a first washing pass using power sweepers and followed by a second pass using washer-dryer machines, with consequent higher maintenance and initial purchase costs for both machines.

Another drawback consists in the fact that, in presence of highly dusty surfaces, the washing mixture passing through the counter-rotating brushes and the water released on the floors by the separator container retaining the solid dirt, results to be muddy, with consequent penalisation of the quality of washing and drying produced by the floor wiper and increase of the costs for washing which may arise from the multiple passes on the spots which remained dirty.

Other known solutions are related to the cleaning of surfaces, but above all of open air areas, roads and curbs, as described, for example, in U.S. Pat. No. 3,197,798; in these cases, such machines do not allow the cleaning of floors, intended as performing not only dirt removal operations, but also washing using detergents and a subsequent drying or, at least, suction of the employed liquid. Yet another drawback consists in the fact that current washer-dryer sweeping machines show a poor operating manoeuvrability and a poor drying ability, especially and mainly while turning and in crowded or small rooms, where the operators are forced to follow paths obliged by the overlapping of the washing tracks and must perform wide turning radiuses in order to avoid leaving wet marks due to the lack of containing systems for the sprayed washing mixtures, and due to floor wipers protruding laterally from said tracks, which require attention as well in order to avoid collisions with possible protruding obstacles.

Another drawback consists in the fact that, in presence of waterproof floors having zones which are more or less absorbing, the operators must manually modify the flows of washing fluids, with the inevitable condition of a non accurate adjustment which is reflected on the final quality of the correct cleaning.

Yet another drawback consists in the fact that the current floor wipers lower themselves and rub on the floors in a pivoting way by means of lever arms which, in presence of subsidences or holes, produce oscillations which vary the inclination of the rubbers modifying the detergent action thereof; moreover, considering that the current suction means have high depression but limited airflow, in presence of zones with a lot of water, the machines must drastically reduce the feed speed in order to allow a sufficient drying of the processed surfaces.

The object of this invention is to eliminate the above drawbacks by means of a single washer-drier scrubbing machine provided with a containing unit for the front and lateral flows of the washing mixtures oriented towards a central operating brush and towards the washing track along which it proceeds, characterised according to what expressed in the first claim. Other characteristics form the object of the dependent claims.

The advantages achieved by the present invention essentially consist in the fact that with a single washer-drier scrubbing machine it is possible to sweep, wash and dry at the same time and in a perfect way any kind of floor, operating in line in cramped or crowded rooms and/or with steering manoeuvres around itself in both direction, notwithstanding the fact that it has a rear floor wiper having equal and in any case not bigger dimensions than the width of its structure.

Another advantage consists in that with the directional containing and guiding system for the flow of the front washing mixture to the operating brush it is possible to achieve a saving of water and detergents in the order of at least 50% because lateral dispersions of the washing mixtures on the floors cannot occur, mainly during the turning stages, because the dispensing thereof is perfectly calibrated, guided and kept within the limits of the front outline of the operating brush and is totally collected, together with the substantial dirt, leaving on the floors only a thin layer of washing mixture which shall be then dried by the rear floor wiper, leaving a perfectly clean, dry and not slippery floor.

A further advantage consists in that, being able to turn on itself in spaces defined only by its dimensions, it may quickly and advantageously linger and pass again the spots where the dirt is tougher, without loosing a lot of time and act without any problem in any room.

Yet another advantage consists in that the operation of the machine according to the invention allows to perform all the operations of cleaning and washing of floors in a single and simultaneous action, reducing near to half the operation times and limiting both the initial purchase costs, being the operating machine only one, and the costs for water and detergents, being the relevant consumptions continuously adjusted without wastes and/or dispersions which are useless and contrasting with modern environmental needs, for the protection of environment.

Another advantage consists in that, during the progress of the machine, quantity, containment and aimed orientation of the washing mixture flow towards the front operating brush remains substantially constant, allowing a better aggression of dirt with increased chemical reaction of the mixture itself and an optimising the washing operations.

A further advantage consists in that the optimising of the containment and the aimed orientation of the washing mixture flow towards the front operating brush allow the employment of a rear floor wiper which does not protrude from the washing track; this allows to wipe and wash at the same time both on the wet and in presence of a significant quantity of dirt, and without compromising the drying of the floors, all this thanks to the action of the compressed air discharged by diffusers laterally to the front part of the operating brush, the air thereof keeps the detergent mixtures in stream along the track subject to washing, within a dimension of the floor wiper itself, even in case of rotation of the machine on itself, in spaces delimited by its dimensions.

Another advantage is derived from the structure of the floor wiper which consists in being placed close to the rear wheels and in being apt to be lowered in working positions and to be risen in order to follow the eventual shape of subsidences or holes of the floors to be washed and to keep unchanged the inclination of the frame of the floor wiper and of the shaped rubbing rubbers, keeping them always in a position on an edge in order to collect the dirty water which is sucked through a suction and high airflow fan.

A further advantage derives from the fact that it is no longer required to perform adjustments of the washing mixture flow due to the fact that the latter is accumulated and directed front-wise towards the operating rotating brush, even in the event of floors of different kind, such as industrial concrete, granite or other.

Another advantage consists in that the machine according to the invention comprises a good capacity container-separator for high consistency debris which allows to operate at the same time as a sweeper and washer on the wet even in rooms having high concentrations of dirt; for this reason in the container there is arranged a small bi-helical brush, which prevents the muddy water collected by the operating brush, especially when rooms with a lot of dust are swept-washed from falling back on the floor but to be recovered; such action also guarantees a significant filtering of dusts with respect to the air in the environment.

Moreover, the drying washing sweeping function, deriving from the conveying of compressed air discharged by lateral diffusers towards the openings arranged in front position respect to the operative rotating brush allow the optimising of the collection of debris and dirt in general.

Figure 2:
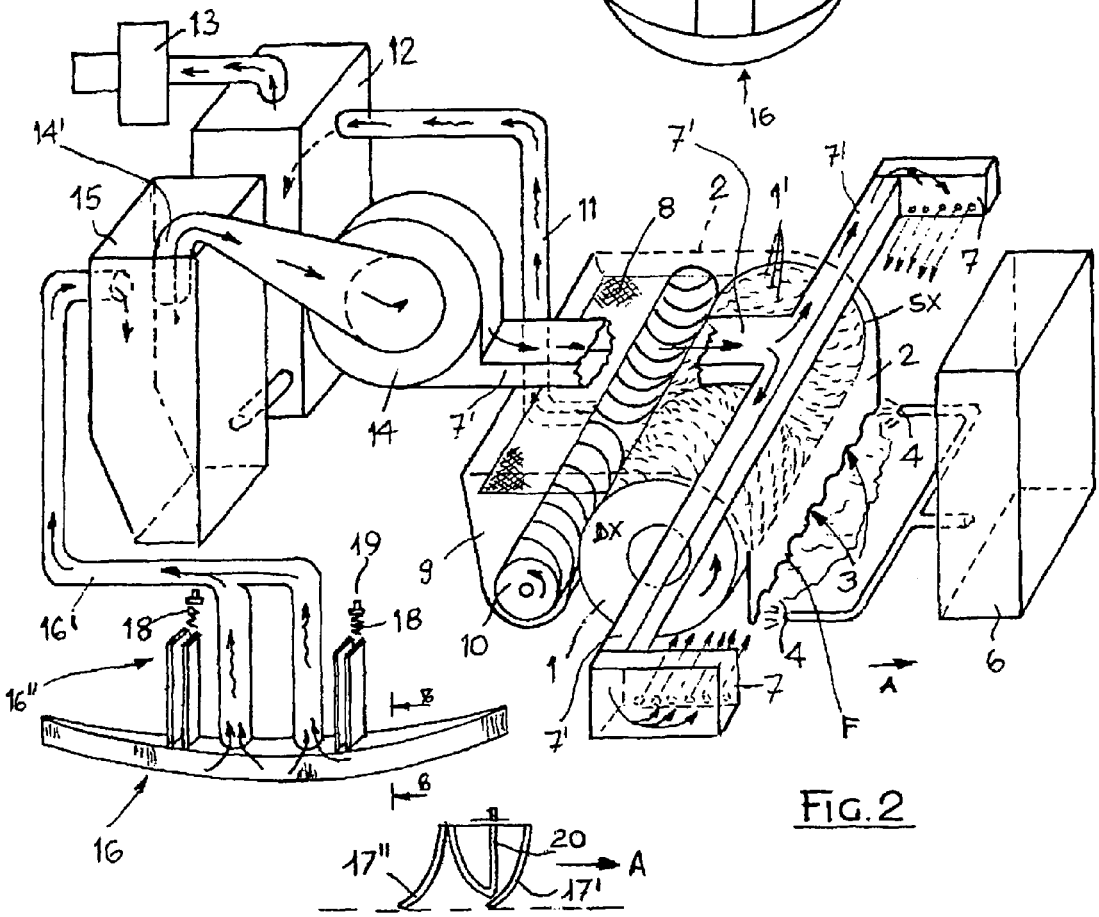

The invention is described in detail hereinafter, according to an embodiment thereof given only by way of a non-limiting example, with reference to the attached drawing, wherein:

FIG. 1 shows the block diagram of the circuits of the washer-drier scrubbing machine according to the invention, and FIG. 2 shows a schematic perspective view of the same circuit.

With reference to the drawings, the washer-drier scrubbing machine with containing and aimed and guided orientation system for the front flow of the washing mixture, directed towards the washing track along which it proceeds, according to the invention, comprises a structure (2) which contains a front rotating roll brush (1) the peripheral surface thereof being covered of spiked bristles (1') facing upwards and converging from the L and R extremity edges towards its central symmetry axis (Y) in the proximity of its front part, facing the operating zone, the rotating roll brush (1) is arranged facing the lower part of the structure (2) whereon a flap (F) is arranged which comprises a number of small aligned openings (3) oriented and facing the floors to be washed.

At the sides of the casing (2), facing the ground, some sprayers (4) fed with water-detergent mixtures through a pump (5) connected to a tank (6) are aligned.

In the proximity of the sprayers (4) there are arranged as many diffusers of compressed air (7) oriented towards the ground facing the base of the structure (2), and then oriented towards said aligned openings (3) with the specific function to prevent that the discharged washing mixture could expand outside the outline of said structure (2), is conveyed only and exclusively towards the openings (3) and therefore towards the rotating brush (1).

Namely, the washing mixture is introduced on the ground only, and not beyond, within the track along which the washer-drier scrubbing machine proceeds according to the invention.

With the progress (A) of the machine, the rotating brush (1) rotating anti-clockwise, performs a washing action on the ground, collecting muddy water and rubbish, and conveying everything in a separator container (8) which retains the high consistency dirt, leaving the dirty water to settle in an intermediate container (9) wherein a bi-helical screw brush (10) is arranged converging to the centre, in the correspondence thereof is arranged a suction duct (11) connected to a tank (12) with suction motor (13).

The compressed air which, through ducts (7'), feeds the diffusers (7) oriented towards the floor facing the base of the structure (2) is produced by a fan (14) the suction inlet thereof is arranged inside a second tank (15) and has as well the function to suck and discharge in said tank, through ducts (16'), the dirty water which is collected from the processed floors by a rear floor wiper (16) having a parabolic shape.

Said floor wiper, which does not protrude from the outer outline of the machine, is arranged close to the rear wheels of the machine and the lowering thereof on the floors is vertically performed by means of a trolley (16") on guides which allows the lateral oscillations thereof; the pressure of the floor wiper on the floors, which allows to compress the front (17') and rear (17") shaped rubbers, is achieved with elastic means, such as springs (18) having an adjustable regulator (19).

Said springs (18), perform an adjusted pressure on said front (17') and rear (17") shaped rubbers, canting them in the right direction so to make them work on the edge in order to achieve the best drying of the floors.

The edge position is kept unchanged, even if the rubbers (17', 17") lose consistency due to the seasonal thermal excursions and the prolonged contact with detergent products, by means of adjustable end blocks (20).

During the contact phase of the shaped rubbers with the floors, the front one (17'), being more extended than the rear one (17"), cants towards the interior of the structure of the floor wiper (16) and the end blocks (20) rest against the rubber thereof causing the correct edge operation of the floor wiper, also in the correspondence or the proximity of any subsidence and/or irregularity of the floors to process.

The invention claimed is:

1. Washer-drier scrubbing machine comprising a rotating roll brush (1) having anticlockwise rotation, characterised in that the brush thereof is arranged close to a structure (2) with the lower edge provided with a "flap" (F) comprising aligned openings (3) facing the floors, at the sides of said "flap" being arranged some sprayers (4) of water-detergent mixtures and diffusers of compressed air (7) oriented towards the openings thereof (3) and the brush thereof (1) whereto are associated a separator (8) and an intermediate container (9) comprising a bi-helical screw brush (10) converging to the centre and communicating with a tank (12) with suction motor (13); said diffusers of compressed air (7) being fed by a fan (14) the suction inlet thereof, arranged inside a tank (15) act as a suction and collection element for the dirty water collected by a parabolic rear floor wiper (16) provided with pressure regulating means for some shaped rubbing rubbers, front (17') and rear (17").

2. Washer-drier scrubbing machine according to claim 1, characterised in that the peripheral surface thereof of said anticlockwise rotating roll (1) is covered of spiked bristles (1') facing upwards and arranged from the (R) and (L) sides towards the central symmetry axis (Y).

3. Washer-drier scrubbing machine according to claim 1, characterised in that the dirt having the bigger consistency collected by said brush (1) settles in said separator (8).

4. Washer-drier scrubbing machine according to claim 1, characterised in that the liquid portion collected by said brush (1), is collected in said container (9) comprising said bi-helical screw brush (10) converging to the centre and is recalled in said tank (12) through a duct (11) connected to the suction motor (13).

5. Washer-drier scrubbing machine according to claim 1, characterised in that said floor wiper (16) does not protrude from the outer outline of the machine and of said rotating brush (1), is arranged close to the rear wheels of the machine and the vertical lowering thereof on the floors is achieved by means of a trolley (16") sliding on guides which allows lateral oscillations thereof.

6. Washer-drier scrubbing machine according to claim 1, characterised in that the pressure of said floor wiper (16) on the floors, which compresses said front (17') and rear (17") shaped rubbers, is achieved with elastic means, such as springs (18) having an adjustable regulator (19).

7. Washer-drier scrubbing machine according to claim 1, characterised in that during the contact phase of said shaped rubbers (17', 17") with the floors they cant towards the interior of the structure of the floor wiper (16) and comprise resting end blocks (20) causing the correct edge operation, also in the correspondence or the proximity of any subsidence and/or irregularity of the floors to process.

* * * * *